US009583045B2

(12) United States Patent
Chen et al.

(10) Patent No.: US 9,583,045 B2
(45) Date of Patent: Feb. 28, 2017

(54) DISPLAY CONTROL CIRCUIT AND METHOD THEREOF

(75) Inventors: Jian-Kao Chen, Hsinchu County (TW); Kuo-Hsiang Hung, Hsinchu County (TW)

(73) Assignee: MSTAR SEMICONDUCTOR, INC., Hsinchu Hsien (TW)

( * ) Notice: Subject to any disclaimer, the term of this patent is extended or adjusted under 35 U.S.C. 154(b) by 234 days.

(21) Appl. No.: 13/479,466

(22) Filed: May 24, 2012

(65) Prior Publication Data

US 2012/0299977 A1 Nov. 29, 2012

(30) Foreign Application Priority Data

May 25, 2011 (TW) ..... 100118242 A

(51) Int. Cl.
*G09G 5/10* (2006.01)
*G09G 3/34* (2006.01)

(52) U.S. Cl.
CPC ..... *G09G 3/3406* (2013.01); *G09G 2320/064* (2013.01); *G09G 2320/0646* (2013.01); *G09G 2360/16* (2013.01)

(58) Field of Classification Search
CPC ..... G09G 2320/0646; G09G 2360/16; G09G 3/3406; G09G 2330/021
USPC ..... 345/690
See application file for complete search history.

(56) References Cited

U.S. PATENT DOCUMENTS 8,421,740 B2 * 4/2013 Watanuki ..... G09G 3/3426 345/102
2009/0219244 A1 * 9/2009 Fletcher et al. ..... 345/102
2010/0053061 A1 * 3/2010 Leung ..... G09G 3/3406 345/102
2011/0249039 A1 * 10/2011 Ogi et al. ..... 345/690

* cited by examiner

*Primary Examiner* — Kwin Xie
(74) *Attorney, Agent, or Firm* — WPAT, PC; Justin King; Jonathan Chiang

(57) ABSTRACT

A display control circuit is capable of adjusting backlight intensity according to image content as well as compensating pixel values of frames for power saving and distortion reduction. The display control circuit includes a threshold determining circuit, a pulse width modulation (PWM) control circuit and a pixel value adjusting circuit. The threshold determining circuit determines a threshold according to a reference value by histogramming a to-be-displayed frame. The threshold is smaller than an upper limit of the pixel values, and a proportion of the number of pixel values between the threshold and the upper limit which occupy a total pixel number is lower than the reference value. The PWM control circuit generates a PWM signal for controlling a backlight luminance according to the threshold. The pixel value adjusting circuit adjusts the values of the pixels according to the threshold.

20 Claims, 4 Drawing Sheets

DISPLAY CONTROL CIRCUIT AND METHOD THEREOF

CROSS REFERENCE TO RELATED PATENT APPLICATION

This patent application is based on Taiwan, R.O.C. patent application No. 100118242 filed on May 25, 2011.

FIELD OF THE INVENTION

The present invention relates to a display panel, and more particularly, to a display control circuit applicable to a display panel and an associated method thereof.

BACKGROUND OF THE INVENTION

In a general display panel, e.g., a liquid crystal display (LCD) panel adopting a light emitting diode (LED) or a cold cathode fluorescent lamp (CCFL) as a backlight source, a backlight module is the most power-consuming component. When the display panel is applied to a mobile apparatus, e.g., a laptop or a mobile phone, power-saving performance of the backlight module is critical for battery life of the mobile apparatus.

A method for adjusting backlight intensity of a display panel according to content of a frame content as well as compensating pixel values of the frame according to backlight adjustment is needed in the art to simultaneously achieve effects of power saving and distortion reduction of the frame.

SUMMARY OF THE INVENTION

In view of the foregoing issues, one object of the present invention is to provide a display control circuit and method thereof capable of adjusting backlight intensity of a display panel according to content of a frame as well as compensating pixel values of the frame according to backlight adjustment for power saving and distortion reduction.

A display control circuit applicable to a display panel comprises a threshold determining circuit, for determining a threshold by histogramming a to-be-displayed frame according to a reference value; a pulse width modulation (PWM) control circuit, coupled to the threshold determining circuit, for generating a PWM signal for controlling a backlight luminance of the display panel according to the threshold; and a pixel value adjusting circuit, coupled to the threshold determining circuit, for adjusting the values of the pixels according to the threshold.

A display control method applicable to a display panel is also provided. The method determines a threshold value according to a reference value by histogramming a to-be-displayed frame; generates a PWM signal for controlling a backlight luminance of the display panel; and adjusts values of the pixels according to the threshold. The reference value is preferably programmable by an end user, but may be hard coded or pre-configured.

The advantages and spirit related to the present invention can be further understood via the following detailed description and drawings.

DETAILED DESCRIPTION OF THE PREFERRED EMBODIMENT

A display control circuit provided by the present invention is applicable to a display panel, e.g., an LCD display panel, to control a backlight luminance so as to save power and compensate frame content. Regardless of the content of image frames to be displayed on the display panel, fixed backlight luminance unnecessarily increases power consumption of the display, and is advantageously controlled using the instant invention to conserve power and enhance imaging.

Figure 1:
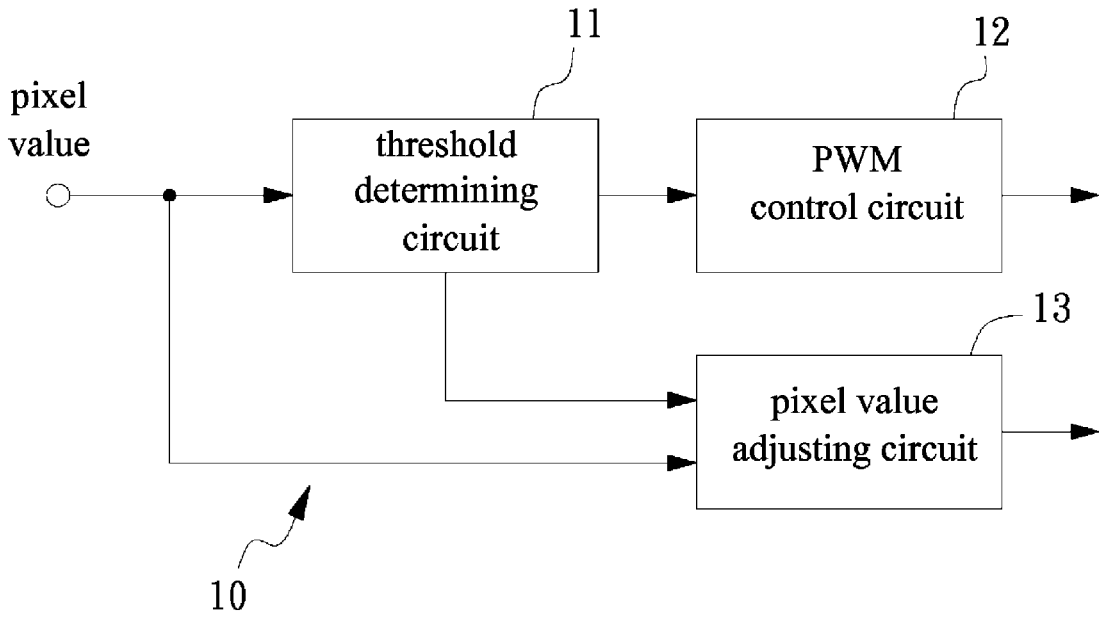
FIG. 1 is a block diagram of a control circuit in accordance with an embodiment of the present invention.

FIG. 1 shows a block diagram of a display control circuit 10 in accordance with an embodiment of the present invention. The display control circuit 10 comprises a threshold determining circuit 11, a PWM control circuit 12, and a pixel value adjusting circuit 13. The threshold determining circuit 11 determines a threshold according to a reference value by histogramming a to-be-displayed frame, e.g. counting the number of values of a plurality of pixels of a to-be-displayed frame. The reference value is generally programmable by an end user. The pixel value may be a luminance value of a pixel, or a maximum pixel component in each dimension of a color space, for instance. For example, a pixel has a red component, a green component, and a blue component in an RGB color space. The pixel value may be the maximum of the three pixel components. Preferably, the luminance value can be applied to decrease the backlight intensity while the maximum pixel value can be applied to maintain more image details of the current content. The threshold is not larger than an upper limit of the pixel values, and a proportion that the number of pixel values between the threshold and the upper limit of the pixel values occupy a total pixel number of the pixels of the to-be-displayed frame is lower than a reference value. Preferably, based on the reference value, the threshold determining circuit 11 determines a corresponding threshold according to image content, i.e., the pixel values, of the frame, so that the proportion for the number of pixels value between the threshold and the upper limit over the total pixel number is lower than the reference value.

When the backlight luminance is decreased for power saving, the pixel values of the frame are proportionally increased to maintain the normal display luminance of the pixels on the display panel. Therefore, when an adjustment factor of the backlight luminance is equivalent to the ratio of the threshold to the upper limit (i.e., the threshold/the upper limit), an adjustment factor of the pixel values is the accompanying reciprocal, i.e., the ratio of the upper limit to the threshold ("the upper limit/the threshold"). At this point, pixel values between a lower limit of the pixel values and the threshold are adjusted according to the adjustment factor of the pixel values. However, since the pixel values between the threshold and the upper limit can be adjusted at most to the upper limit due to the limitation of the upper limit, original different pixel values are saturated to the same upper limit thus introducing image distortion. In this embodiment, since the proportion that the number of the pixel values between the threshold and the upper limit occupy the total pixel number is lower than the reference value, it is ensured that at least the proportion, i.e. (1−the reference value), of the adjusted pixel values are not distorted. Therefore, a predetermined allowed distortion proportion, i.e., the reference value, is programmed before the frame is to be displayed. After that, a proper threshold is determined according to the frame content, and the backlight luminance is adjusted and the pixel values are compensated according to the threshold, so as to control the distortion proportion of the to-be-displayed frame.

Figure 2:
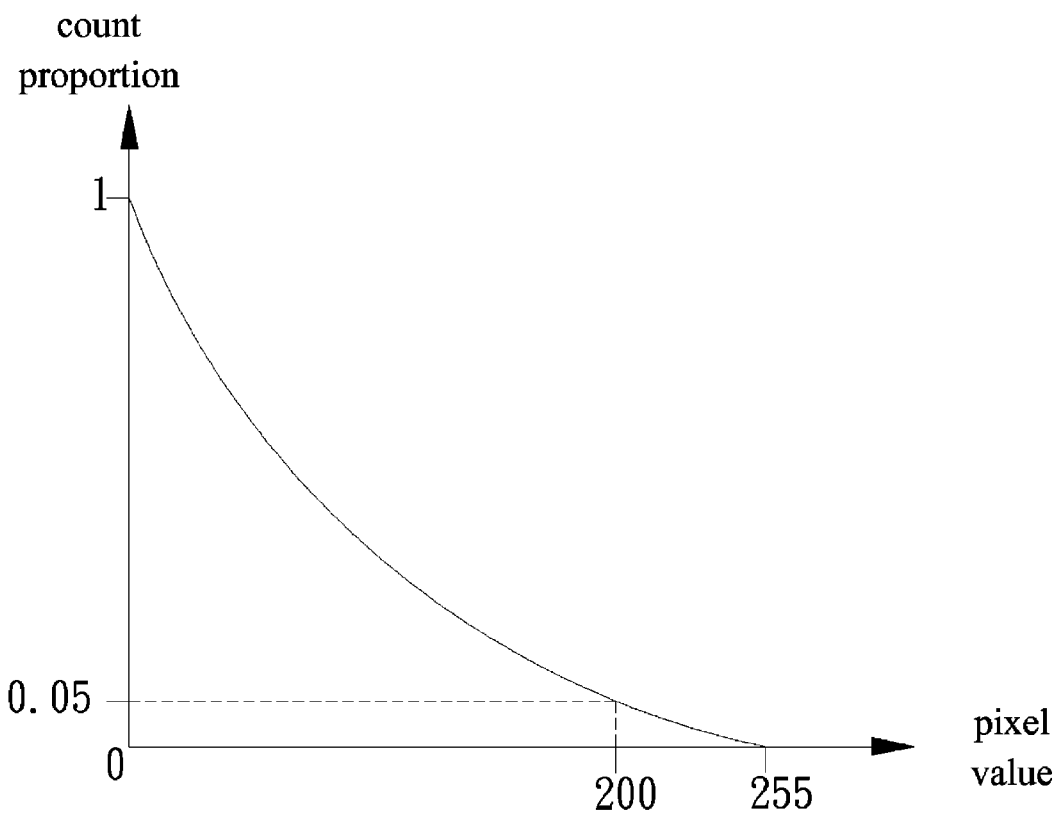
FIG. 2 is a diagram of a threshold in accordance with an embodiment of the present invention.

For example, suppose that each pixel value is represented by a total of eight bits, whose values are ranging from 0 to 255, i.e., 0 and 255 are respectively the lower limit and the upper limit of the pixel values. Referring to FIG. 2, a curve by counting pixel values of a frame is depicted, where the horizontal axis represents the pixel values, and the vertical axis represents a count proportion (ranging from 0 to 1), which represents a proportion of the number of pixel values occupying the total pixel number. For example, the pixel value threshold 200 corresponds to the pixel count proportion equal to the reference value 0.05; this means that the proportion of the number of the pixels between 200 and 255 which occupy the total pixel number is lower than 0.05.

The PWM control circuit 12 generates a PWM signal for controlling the backlight luminance of the display panel according to the threshold determined by the threshold determining circuit 11. In this embodiment, the PWM control circuit 12 adjusts a pulse width, i.e. duty cycle, of the PWM signal according to the threshold and transmits the adjusted PWM signal to the backlight module to produce a desired backlight luminance. Since the pulse width of the PWM signal is proportional to the backlight luminance generated by the backlight module, the pulse width is adjusted to control the backlight luminance. Preferably, an adjustment factor is determined by dividing the threshold with the upper limit of the pixel values. Referring to FIG. 2, the threshold is 200 and the upper limit of the pixel values is 255, and the adjustment factor of the pulse width is 255/200, i.e., the adjusted pulse width is equal to the original pulse width×(255/200), where the original pulse width is the pulse width when the duty pulse is 50%.

The pixel value adjusting circuit 13 adjusts values of the pixels of the frame according to the threshold determined by the threshold determining circuit 11 to compensate influences of the pixel luminance created due to adjustment of the backlight luminance. The pixel values can be adjusted via the following two manners (but are not solely limited to these two expressly described manners).

Figure 3:
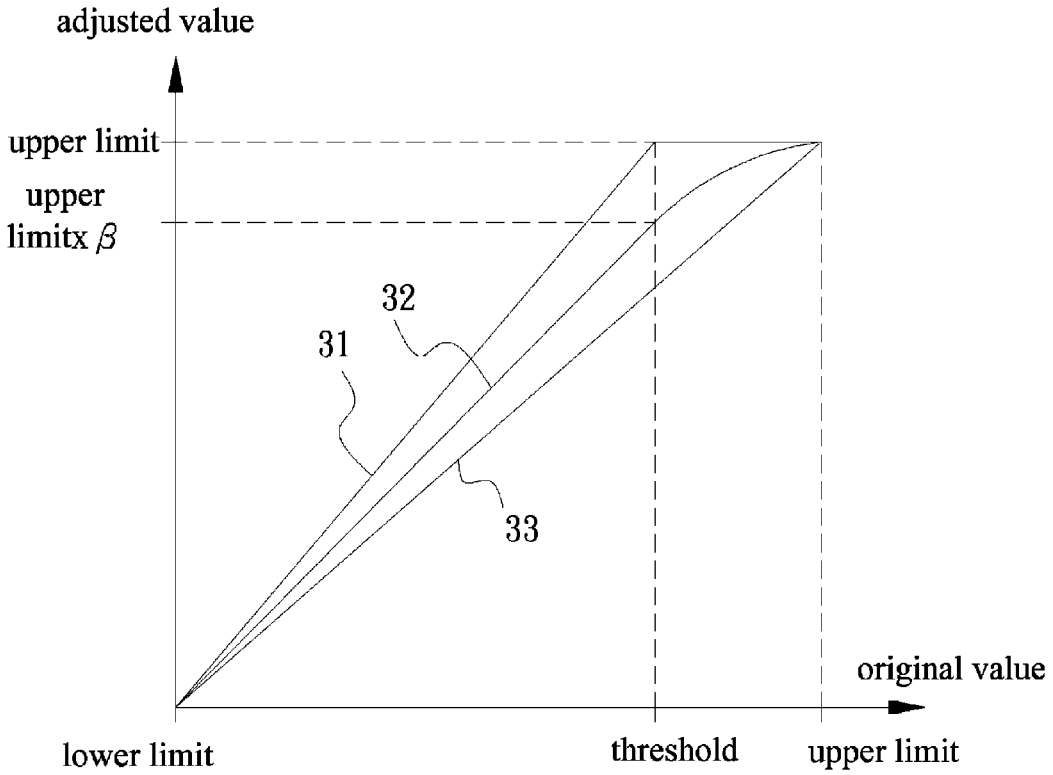
FIG. 3 is a diagram of an adjustment curve for adjusting pixel values in accordance with an embodiment of the present invention.

The first manner is that, the pixel values between the lower limit and the threshold, i.e. equal to the threshold/the upper limit, are divided with the adjustment factor of the pulse width of the PWM signal, i.e., the adjustment factor of the pixel values is the reciprocal of that of the pulse width. The pixel values between the threshold and the upper limit are adjusted to the upper limit of the values according to a curve 31 as shown in FIG. 3. The horizontal axis and the vertical axis respectively represent unadjusted values and adjusted values. It is noted from the curve 31 that, when an unadjusted value is between the lower limit and threshold, the adjusted value is generated by multiplying the value by the reciprocal of the adjustment factor of the pulse width, i.e., the slope of the diagonal part of the curve 31 equals the ratio of the upper limit to the threshold (i.e., the upper limit/the threshold). When an unadjusted value is between the threshold and the upper limit, the adjusted value is adjusted to the upper limit. In addition, a curve 33 represents the unadjusted values in comparison with the curve 31.

In the foregoing adjustment manner, the pixel values between the lower limit and the threshold maintains unchanged as the original luminance according to the adjustment of the backlight luminance. However, the pixel values between the threshold and the upper limit are all saturated to the same upper limit of the pixel values. In the second adjustment manner, for the pixel values between the lower limit and the threshold, the original adjustment factor, i.e., the upper limit/the threshold, needs to be decreased, e.g., the adjustment factor is multiplied by β, where $0<\beta<1$. For example, when the unadjusted pixel value is the threshold, it is adjusted to the upper limit and is multiplied by β according to the curve 32 as shown in FIG. 3. The pixel values between the threshold and the upper limit are adjusted within a range from the upper limit multiplied by β to the upper limit. Accordingly, the luminance of the pixel value between the lower limit and the threshold is slightly decreased; the pixel values between the threshold and the upper limit are not saturated to the upper limit so as to display more image details.

In this embodiment, the pixel value adjusting circuit 13 comprises a built-in gain table (not shown) for storing a plurality of gain values. The pixel value adjusting circuit 13 selects one gain value from the gain table according to a pixel value to adjust the pixel value, e.g., the pixel value is multiplied by the selected gain value to obtain an adjusted pixel value. When unadjusted pixel value is between the lower limit and the threshold, the pixel value adjusting circuit 13 selects from the gain table the same gain value (i.e., the upper limit/the threshold×β) to adjust the pixel value. When the unadjusted pixel value is between the threshold and the upper limit, the pixel value adjusting circuit 13 selects from the gain table an appropriate corresponding gain value to adjust the pixel value. At this point, the corresponding gain value may be different according to different pixel values so that the pixel value can be adjusted within the range from the upper limit multiplied by β to the upper limit smoothly.

Figure 4:
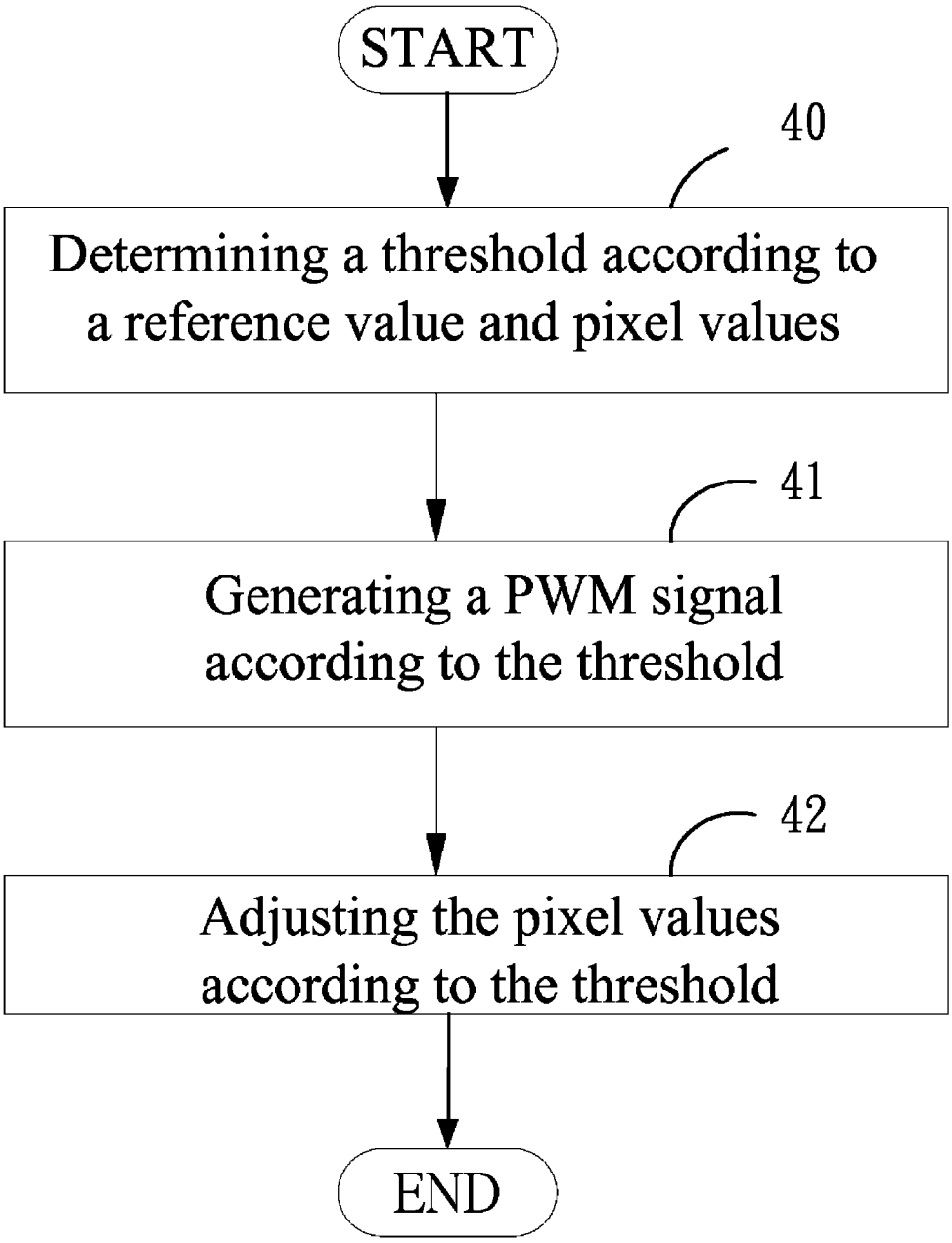
FIG. 4 is a flow chart of a display control method in accordance with an embodiment of the present invention.

FIG. 4 shows a flow chart of a display control method in accordance with an embodiment of the present invention. In Step 40, a threshold is determined according to a reference value and pixel values of a plurality of pixels of a to-be-displayed frame. For example, the threshold is not larger than an upper limit of the pixel values, and a proportion that the number of pixel values between the threshold and the upper limit occupy a total pixel number is lower than the reference value. Each pixel value is a luminance value of a pixel or a maximum pixel component in each dimension of a color space.

In Step 41, a PWM signal for controlling a backlight luminance of a display panel is generated according to the threshold. A pulse width of the PWM signal is adjusted according to an adjustment factor that is determined according to the threshold and the upper limit, and preferably, the adjustment factor is equal to the threshold/the upper limit.

In Step 42, the pixel values are adjusted according to the threshold via two following manners (but adjustment is not limited to these two manners specifically).

The first manner is that, the pixel values between the lower limit and the threshold are divided with the adjustment factor (i.e., the threshold/the upper limit) of the pulse width of the PWM signal, and the pixel values between the threshold and the upper limit are adjusted to the upper limit.

The second manner is that, for the pixel values between the lower limit and the threshold, an original adjustment factor (i.e., the upper limit/the threshold) is decreased, e.g., the adjustment factor is multiplied by β, where $0<\beta<1$, and the pixel values between the threshold and the upper limit are adjusted within a range from the upper limited multiplied by β to the upper limit.

In this embodiment, Step 42 further comprises steps of providing a gain table for storing a plurality of gain values, and selecting from the gain table one gain value according to one pixel value to adjust the pixel value. For the pixel values between the lower limit and the threshold, a same gain value is applied from the gain table to adjust the pixel values, and the gain value is the foregoing adjustment factor of the pulse width. For the pixel values between the threshold and the upper limit, an appropriate corresponding gain value is selected from the gain table to adjust the pixel values, so that the pixel values are adjusted within the range from upper limit multiplied by β to the upper limit.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A display control circuit, applicable to a display panel, comprising:

a threshold determining circuit, for determining a threshold by histogramming a plurality of values of a plurality of pixels of a to-be-displayed frame according to a reference value, wherein the reference value is a predetermined distortion proportion, the threshold is a specific pixel value, and the threshold is determined such that a proportion defined by a number of pixels between the threshold and the upper limit and a total pixel number is lower than the reference value;

a pulse width modulation (PWM) control circuit, coupled to the threshold determining circuit, for generating a PWM signal for controlling a backlight luminance of the display panel according to the threshold; and a pixel value adjusting circuit, coupled to the threshold determining circuit, for adjusting a pixel value of each pixel of the plurality of pixels according to whether said pixel value is between the upper limit and the threshold or between a lower limit and said threshold;

wherein the threshold is smaller than an upper limit of the pixel values, and the reference value is equal to: 1−P; and wherein P is said proportion defined by the number of pixel values between the threshold and the upper limit and the total pixel number.

2. The display control circuit as claimed in claim 1, wherein each pixel value represents a luminance value or a maximum pixel component in a plurality of dimensions of a color space.

3. The display control circuit as claimed in claim 1, wherein the PWM control circuit adjusts a pulse width of the PWM signal according to the threshold.

4. The display control circuit as claimed in claim 3, wherein an adjustment factor of the pulse width is determined according to the threshold and the upper limit of the pixel values.

5. The display control circuit as claimed in claim 4, wherein the adjustment factor is determined by dividing the threshold by the upper limit of the pixel values.

6. The display control circuit as claimed in claim 5, wherein when the pixel value adjusting circuit adjusts the pixel values, a first plurality of pixel values between a lower limit of the pixel values and the threshold are divided with the adjustment factor.

7. The display control circuit as claimed in claim 6, wherein the pixel value adjusting circuit adjusts a second plurality of pixel values between the threshold and the upper limit of the pixel values to the upper limit of the pixel values.

8. The control circuit as claimed in claim 1, further comprises:

a gain table, for storing a plurality of gain values;

wherein, the pixel value adjusting circuit selects from the gain table one gain value according to the pixel values to adjust the pixel values.

9. The display control circuit as claimed in claim 1, wherein the reference value is programmable by an end user.

10. A display control method, applicable to a display panel, comprising:

histogramming a plurality of pixels of a to-be-displayed frame to generate a histogram by counting a number of pixel values of said plurality of pixels;

determining a threshold according to a reference value and said histogram such that a proportion defined by a number of pixels between the threshold and the upper limit and a total pixel number is lower than the reference value, wherein the threshold is a specific pixel value, and the reference value is a predetermined distortion proportion;

generating a PWM signal for controlling a backlight luminance of the display panel according to the threshold; and adjusting a pixel value of each pixel of the plurality of pixels according to whether said pixel value is between the upper limit and the threshold or between a lower limit and said threshold;

wherein the threshold is smaller than an upper limit of the pixel values, and the reference value is equal to: 1−P; and wherein P is said proportion defined by the number of pixel values between the threshold and the upper limit and the total pixel number.

11. The method as claimed in claim 10, wherein each pixel value represents a luminance value or a maximum pixel component in a plurality of dimensions of a color space.

12. The method as claimed in claim 10, wherein the step of generating the PWM signal adjusts a pulse width of the PWM signal according to the threshold.

13. The method as claimed in claim 12, wherein an adjustment factor of the pulse width is determined according to the threshold and the upper limit of the pixel values.

14. The method as claimed in claim 13, wherein the adjustment factor is determined by dividing the threshold by the upper limit of the pixel values.

15. The method as claimed in claim 14, wherein the step of adjusting the pixel values is to divide a first plurality of pixel values between a lower limit of the pixel values and the threshold with the adjustment factor.

16. The method as claimed in claim 15, wherein the step of adjusting the pixel values adjusts a second plurality of pixel values between the threshold and the upper limit of the pixel values to the upper limit of the pixel values.

17. The method as claimed in claim 10, wherein the step of adjusting the pixel values further comprises:

providing a gain table for storing a plurality of gain values; and selecting from the gain table one gain value according to the pixel values to adjust the pixel values.

18. The method as claimed in claim 10, wherein the reference value is programmable by an end user.

19. The display control circuit as claimed in claim 1, wherein the threshold is smaller than an upper limit of the pixel values, and the reference value is greater than proportion defined by a number of pixel values between the threshold and the upper limit and a total pixel number.

20. The method as claimed in claim 10, wherein the threshold is smaller than an upper limit of the pixel values, and the reference value is greater than a proportion defined by a number of pixel values between the threshold and the upper limit and a total pixel number.

* * * * *